United States Patent [19]

Guenther

[11] Patent Number: 4,976,431

[45] Date of Patent: Dec. 11, 1990

[54] BALL TEE

[76] Inventor: Cameron Guenther, 3314 Aberdeen Avenue, Burlington, Ontario, Canada, L7M 3Y3

[21] Appl. No.: 488,264

[22] Filed: Mar. 5, 1990

[51] Int. Cl.[5] ..... A63B 71/00

[52] U.S. Cl. ..... 273/26 R; 273/33; 273/202; 273/206; 273/212

[58] Field of Search ..... 273/26 R, 29 R, 29 A, 273/33, 202-212

[56] References Cited

U.S. PATENT DOCUMENTS

| | | | |
|---|---|---|---|
| 519,918 | 5/1894 | MacLearn | 272/78 |
| 1,308,253 | 7/1919 | Oftedahl | 248/175 |
| 2,440,473 | 4/1948 | Hughes | 273/206 |
| 2,805,071 | 9/1957 | Kaplan | 273/202 |
| 4,181,311 | 1/1980 | Lawlor | 273/206 |

FOREIGN PATENT DOCUMENTS

| | | | |
|---|---|---|---|
| 233075 | 5/1925 | United Kingdom | 248/175 |

*Primary Examiner*—Theatrice Brown
*Attorney, Agent, or Firm*—Smart & Biggar

[57] ABSTRACT

A ball tee comprising an upright helical spring and a base member which extends downwardly from the column, and is adapted to engage the ground. The upright helical spring consists of a laterally flexible column which flares at its upper end to provide a resting place for a ball. The lowest coils of the helical spring are distorted to create a friction grip between the spring and the base. Preferably, the base member is configured to form a horizontally planar arcuate base, or a stake.

5 Claims, 4 Drawing Sheets

18
16

10
12
28
20
24
22
26
14

18
16

10
12
28
20
22A
24
26
14

18
16

10
12
28
20
14A
32
34

BALL TEE

FIELD OF THE INVENTION

This invention relates to a ball tee.

BACKGROUND OF THE INVENTION

There are several known ball tee devices. One such device is shown in U.S. Pat. No. 4,681,318, issued July 21, 1987 to William C. Lay for a ball hitting practice device. The Lay patent comprises an upright column consisting of several different components in the form of solid bars, springs, and tubes. As the design in such a tee is relatively complex and the tee is basically rigid, it cannot absorb energy evenly at the point of impact. Such uneven energy absorption renders this ball tee susceptible to individual component damage, requiring frequent replacement of parts and resulting in high replacement costs. Also, the device itself is expensive to manufacture.

Though the Lay device does provide for height adjustment by means of a locking collar, the external location of this locking collar exposes it to impact and consequent damage, i.e. it would be difficult to adjust the Lay device for height once the locking collar was damaged.

STATEMENT OF THE INVENTION

The present invention overcomes the above-mentioned drawbacks of the prior art by providing a ball tee which absorbs energy evenly at the point of impact by providing an upright column in the form of a single, flexible component. Also, the device of the invention consists of just two easily replaceable and inexpensive components which provide greater and easier height adjustment than other known ball tees. Thus, the ball tee of the present invention would be more economical to manufacture yet be superior in function, and ease of repair or cost of replacement of parts.

The present invention consists of a ball tee comprising an upright helical spring forming a laterally flexible column which flares at its upper end to provide a resting place for a ball, and whose lowest coils are distorted to create a friction grip between the spring and the base member which extends downwardly from the upright column and is adapted to engage the ground.

BRIEF DESCRIPTION OF THE DRAWINGS

In the accompanying drawings which describe example embodiments of the invention.

DESCRIPTION OF PREFERRED EMBODIMENTS

Figure 1:
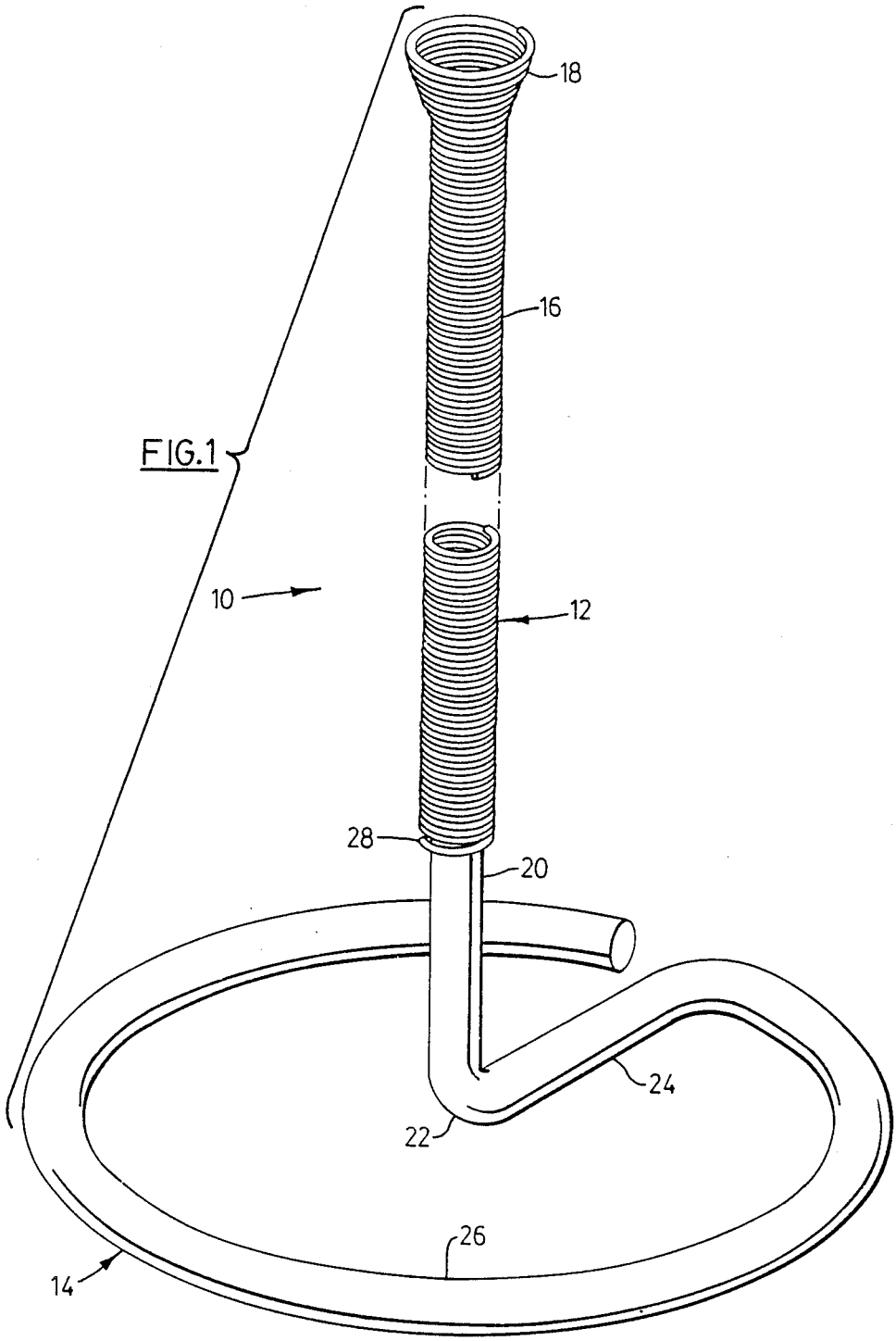
FIG. 1 is a perspective view of a ball tee.
Figure 2:
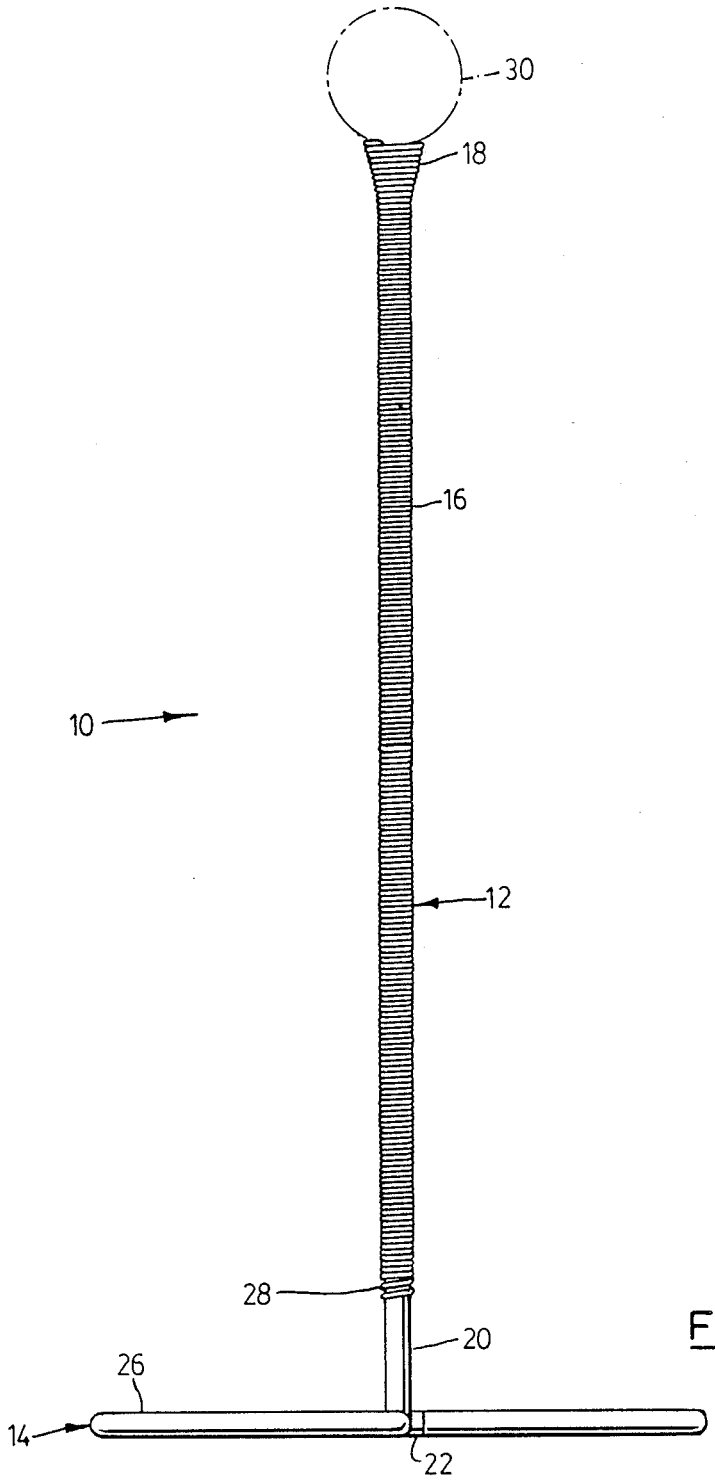
FIG. 2 is a side elevational view of FIG. 1.

The embodiment shown in FIGS. 1 and 2 consists of a ball tee 10 comprising an upright helical spring 12 and an elongated base member 14 which extends downwardly from the helical spring. Helical spring 12 forms a column 16 and flares at its upper end to form a cup 18 which provides a resting place for a ball. Column 16 of spring 12 is laterally flexible.

Base member 14 comprises a vertical post 20 whose lower end merges into an elbow 22 from which extends a horizontal arm 24 terminating in a horizontal ring 26. Spring 12 co-axially engages post 20, and lower portion 28 of spring 12 is distorted to provide a friction grip on the post.

In use, ball tee 10 rests on base 14 with spring 12 in an upright position. A ball 30 is placed in cup 18, as seen in FIG. 2 of the drawings, and is located at a suitable height which may be adjusted upwardly or downwardly by sliding spring 12 along to post 20 of base 14. When ball 30 is struck, the lateral flexibility of column 16 provides resilience, especially if spring 12 is contacted.

Figure 3:
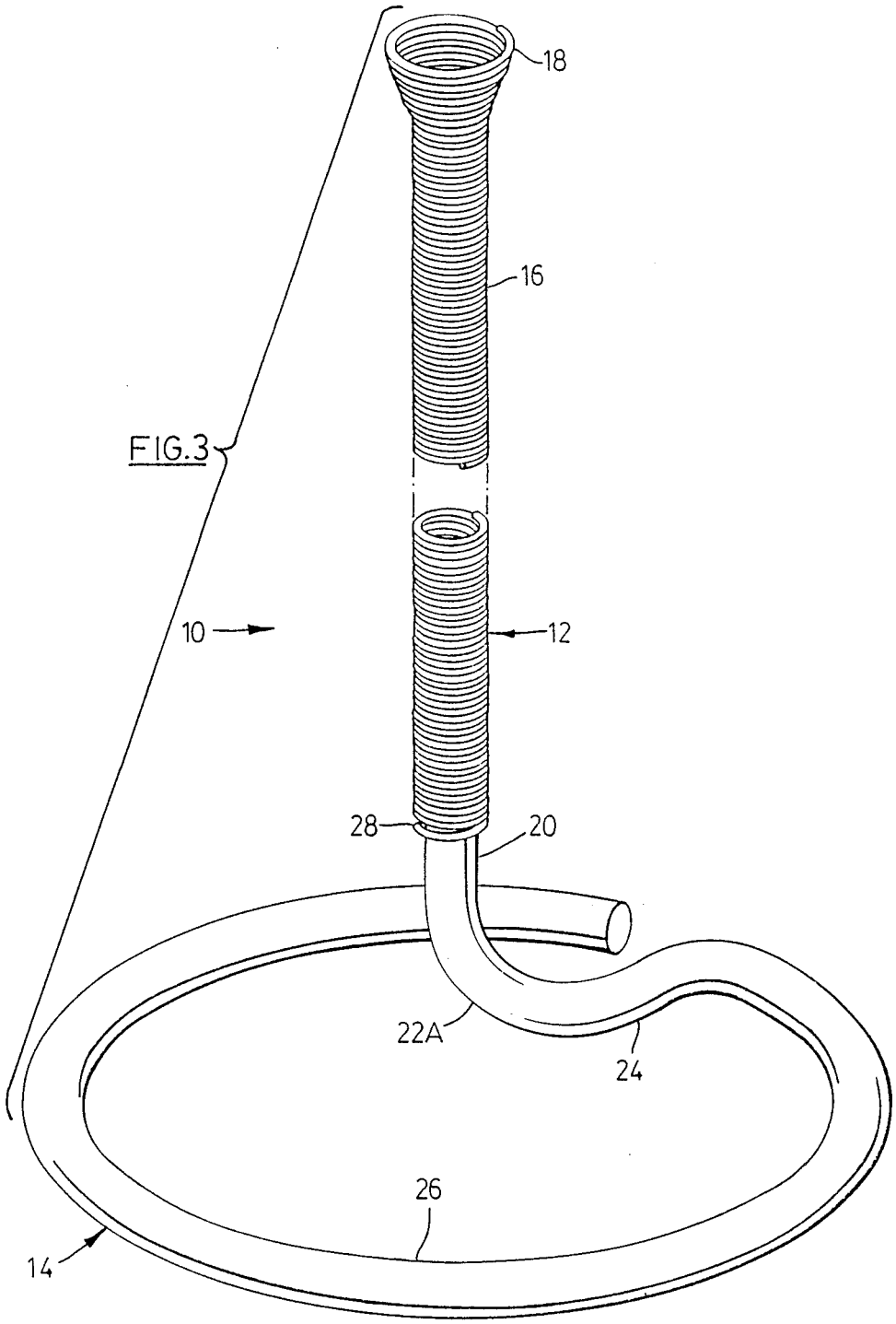
FIG. 3 is a perspective view of a second embodiment of the invention.

The second embodiment of the invention, as seen in FIG. 3, shows a ball tee 10, similar in construction to the embodiment shown in FIGS. 1 and 2, but having an elbow 22A curved from vertical post 20 to horizontal arm 24 with a larger radius of curvature, preferably the same as the radius of the ring 26.

In the second embodiment, shown in FIG. 3, the increased radius of curvature allows spring 12 to slide onto the elbow and onto arm 24 which increases the variability in the height adjustment of cup 18.

Figure 4:
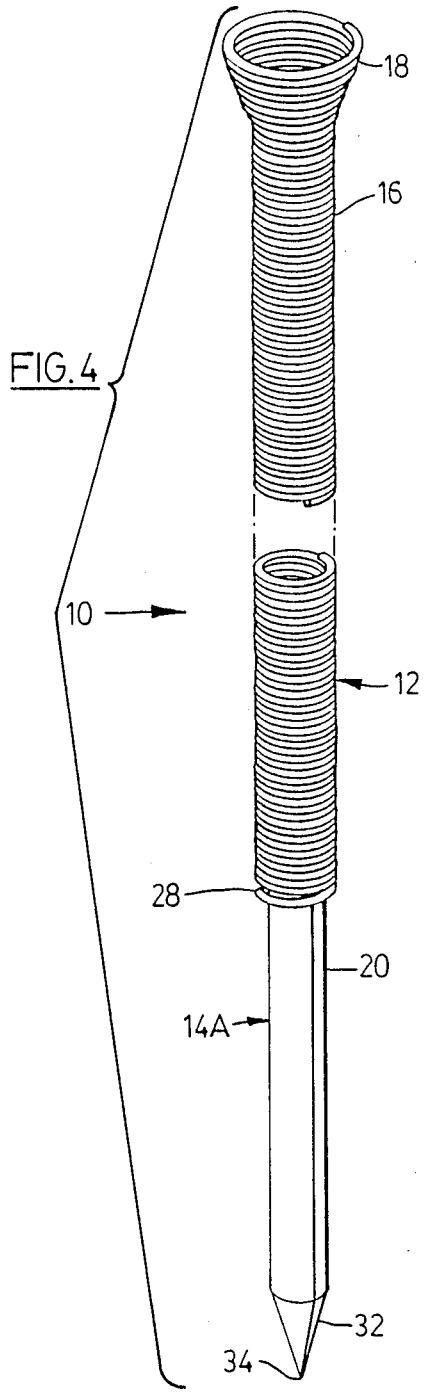
FIG. 4 is a perspective view of a third embodiment of the invention.

A third embodiment of the invention, as seen in FIG. 4, shows a ball tee 10, again similar in construction to the embodiments shown in FIGS. 1 to 3, but having a base member 14A which consists of a tapered lower end 32 of post 20, terminating in a sharp point 34. This enables base member 14A to be driven into the ground as a stake.

I claim:

1. A ball tee comprising:

an upright helical spring forming a laterally flexible column flaring at its upper end to provide a resting place for a ball; and, an elongated base member extending coaxially downward from the upright column and adapted to engage the ground;

the lowest coils of the upright helical spring being distorted to create a slidable friction grip on the base member whereby the spring is slidably adjustable thereon.

2. A ball tee as claimed in claim 1 in which the base member is configured to form a horizontally planar ground support.

3. A ball tee as claimed in claim 2 in which the base member comprises a vertical post engaged by the lower portion of the spring and a horizontal ring, the vertical post and the horizontal ring being interconnected by an elbow and a horizontal arm interconnecting the elbow and the ring.

4. A ball tee as claimed in claim 3 in which the radius of curvature of the elbow is the same as the radius of the ring.

5. A ball tee as claimed in claim 1 in which the base member comprises a stake.

* * * * *